United States Patent [19]

Main

[11] Patent Number: 5,005,448

[45] **Date of Patent: * Apr. 9, 1991**

[54] SPEED WRENCH AND HAND GRIP COMBINATION

[76] Inventor: Harvey M. Main, P.O. Box 376, South Fork, Colo. 81154

[ * ] Notice: The portion of the term of this patent subsequent to Dec. 20, 2005 has been disclaimed.

[21] Appl. No.: 287,476

[22] Filed: Dec. 19, 1988

Related U.S. Application Data

[63] Continuation-in-part of Ser. No. 919,838, Oct. 16, 1986, Pat. No. 4,791,837.

[51] Int. Cl.[5] ..... B25B 13/46

[52] U.S. Cl. ..... 81/63; 81/177.1; 81/489

[58] Field of Search ..... 81/58.1, 62, 63, 63.1, 81/63.2, 120, 121.1, 125, 177.1, 177.2, 492, 489; D5/25, 29

[56] References Cited

U.S. PATENT DOCUMENTS

| | | | |
|---|---|---|---|
| D. 277,160 | 1/1985 | Antone | 81/3.4 X |
| 1,601,767 | 10/1926 | Peterson | 81/58.1 |
| 1,619,043 | 3/1927 | Scheiwer | 81/63.1 |
| 2,512,232 | 6/1950 | Hart | 81/63 X |
| 2,565,961 | 8/1951 | Godfrey | 81/63 X |
| 2,851,915 | 9/1958 | Martinez | 81/177.2 |
| 2,891,434 | 6/1959 | Lozensky | 81/63 X |
| 3,253,485 | 5/1966 | Grote | 81/125 X |
| 3,823,624 | 7/1974 | Martin | 81/58.1 |
| 4,212,336 | 7/1980 | Smith | 81/58.1 X |

FOREIGN PATENT DOCUMENTS

| | | | |
|---|---|---|---|
| 916097 | 8/1946 | France | 81/124.6 |
| 2103977 | 3/1983 | United Kingdom | 81/58.1 |

*Primary Examiner*—James G. Smith
*Attorney, Agent, or Firm*—Timothy J. Martin

[57] ABSTRACT

A speed wrench and complimentary hand grip, the wrench includes a casing which mounts a standard drive mechanism which has a drive member axially projecting from the casing in order to engage a work piece. The wrench has an added feature in the form of a drive head rigidly attached to the casing axially thereof on a side opposite the drive member. The drive head has parallel exterior sides and an interior axial cavity. Thus, the wrench may be torqued by both a normal auxiliary wrench having a wrench head that engages the exterior sides by a normal lug wrench which has a drive lug that may matably engage the cavity. The complimentary handle includes an annular grip portion and nestably receives the wrench. The hand grip has a cylindrical opening sized to receive the wrench casing and bail, and bail engagement means whereby rotation of the handle rotates the wrench. The opening also allows access to the drive head cavity while the handle and wrench are nested.

22 Claims, 3 Drawing Sheets

SPEED WRENCH AND HAND GRIP COMBINATION

BACKGROUND OF THE INVENTION

This application is a continuation-in-part of application Ser. No. 06/919,838 filed Oct. 16, 1986, now U.S. Pat. No. 4,791,837.

The present invention relates to an improved tool which is adapted to rotatably drive a work piece and has an improved auxillary hand grip which permits operation of the tool with greater comfort and mechanical advantage. More particularly, the present invention is constructed as an improved speed wrench which operates through a ratchet mechanism having an output or drive shaft that receives a tool element, such as a socket or other rotatable tool, in order to rotatably drive a work piece.

Numerous tools adapted to rotatably drive a work piece, such as screws, bolts, nuts and the like, have been developed in the past. Those prior art tools include common screwdrivers, wrenches, nut drivers, adjustable wrenches, socket wrenches, to name a few. Of particular interest to the present invention is the tool device known as a speed wrench wherein a reversible ratchet mechanism is carried within a generally cylindrical casing from which an output or drive shaft outwardly projects. A socket selected from a socket set having various socket openings sized to receive differently dimensioned bolt heads or nuts is then removably secured on the drive shaft. The existing speed wrench tools are typically fairly small, hand held units which may be used to quickly tighten or loosen a bolt or nut, even in confined regions. However, due to the relatively small size, the user of a speed wrench often cannot tighten the bolt or nut to the desired torque since no lever arm or handle is formed on the speed wrench to provide mechanical advantage. It is precisely this omission of a lever handle which distinguishes a speed wrench from the closely related ratchet wrench which is used with the same socket set. Accordingly, when the user of the speed wrench desires to rotatably drive a bolt or nut with substantial torque, the user removes the speed wrench and employs a second tool, such as a ratchet wrench, an adjustable wrench, or the like, constructed to give a mechanical advantage about the axis of rotation. Use of the auxillary tool requires that the speed wrench be removed from the work piece, after which the auxillary tool is registered with the work piece so that its drive head registers with and engages the work piece. This removal and engagement of an auxillary tool is often time consuming, and is especially difficult where access to the bolt head or nut is difficult.

Thus, even though speed wrenches and other rotatable tool devices are well known in the prior art, there remains a need for an improved tool which may be used to quickly tighten or loosen a bolt or nut, yet which may remain and act as a torque transfer member so that a second tool may be used to increase the mechanical advantage in applying torque around the rotation axis. There is a further need for such an improved tool, including an improved speed wrench, wherein a complementary hand grip may be employed both to facilitate use of the tool, increase comfort of the user and to increase the mechanical advantage which the user enjoys with the tool. There is a further need for such a hand grip which does not interfere with the application of even further increased mechanical advantage by means of an additional tool.

SUMMARY OF THE INVENTION

It is an object of the present invention to provide a new and useful improvement to a manually rotatable tool device so that an auxillary tool may be applied to the device to gain mechanical advantage during rotation without removing the device from a work piece to be turned.

It is another object of the present invention to provide improved speed wrench device which includes structure to allow application of an auxillary wrench in order to gain mechanical advantage in rotating the device about its drive axis so that a work piece may be tightened or loosened with increased torque.

It is a still further object of the present invention to provide a novel and useful speed wrench device which includes structure to allow the device to be driven by an auxillary wrench and which includes an improved complimentary removable hand grip which nestably mates with the speed wrench in order to increase the comfort of the user and to allow the user to apply greater torque while rotating a work piece.

An additional object of this present invention is to provide a complimentary hand grip which provides the wear and strength advantages of metal construction together with the thermal and electrical insulation advantages of plastic. A further object of the present invention is to provide and improved complimentary hand grip which is simple and inexpensive to manufacture.

A still further objective of the present invention is to provide an improved complimentary hand grip which has low internal stress levels for a given torque.

It is yet a further object of the present invention to provide a speed wrench having structure to allow application of the auxillary wrench in order to allow the user to increase rotational torque, and which includes a complimentary hand grip which may nestably receive the speed wrench without interfering with the ability to employ an auxillary torque wrench.

The preferred form of the invention, therefore, provides an improvement to a tool that is adapted to rotatably drive a work piece. The invention is described with respect to a speed wrench, but the present invention contemplates an improvement to tools in general were such tools have a drive mechanism with a drive member projecting axially from one side of the casing to selectively engage a work piece whereby rotation of the casing rotates the work piece. The improvement comprises a drive head that is rigidly attached to the tool in such manner that the drive head projects axially from the casing on a side opposite of the drive member. The drive head has a raised surface oriented generally in a plane transverse to the common axis of the drive member and the drive head, and the drive head has a plurality of flat exterior sides which are oriented in planes generally parallel to the common axis. The flat exterior sides are organized as pairs of sides which are parallel to one another in order to be engaged by the work head of an auxillary wrench. An axially oriented cavity is formed in the drive head through the raised surface with the cavity having a plurality of flat interior sidewalls oriented along interior planes which are parallel to the common axis. Accordingly, a common ratchet wrench having a drive shank configured to engage the cavity may be used in order to turn the tool with mechanical advantage.

In the preferred form of the present invention, a speed wrench apparatus includes a reversible ratchet mechanism contained within a general cylindrical casing which includes a drive shaft which projects on one side of the casing in order to engage a standard socket from a socket wrench set. A strap-like bail is rigidly secured to the casing so that the strap-like bail stands off from the side of the casing opposite the drive shaft and is rigidly attached to the casing at selected locations along the edge of the casing. The bail axially and rigidly mounts the drive head, with the drive head preferably having a predominantly hexagonal configuration such as a common bolt head or nut. Preferably, the cavity formed in the drive head is square-shaped in cross section and sized to correspond to a common square-shaped shank which is provided, for example, on a standard ratchet wrench.

In either the general embodiment of a tool device or in the specific embodiment of a speed wrench, an improved complimentary hand grip may be provided with the hand grip configured to nestably receive the tool device. The hand grip comprises an annular grip portion having an inner side wall which surrounds the casing in the nested state, and a drive ring partially protruding from the inner side wall. The drive ring includes a keyway receiving the bail and having bail engagement notches to matably engage the bail near its points of attachment along the edge of the casing. When the hand grip is rotated, the keyway engages and rotates the bail, together with the casing and drive head, to rotate the tool. The keyway provides a registration means to align the hand grip with the tool, so that the hand grip may only be mated with the tool in selected rotational orientations. A detent structure may be provided to resiliently resist removal of the hand grip from the tool.

The annular grip portion of the improved auxillary hand grip may be formed of an integrally molded, high impact plastic. The drive ring may be fashioned of sheet metal and molded into the hand grip when it is formed with a portion of the metal comprising the bail engagement notches projecting from the inside wall of the annular grip portion to engage the bail when the hand grip and tool are in the nested state.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

Figure 1:
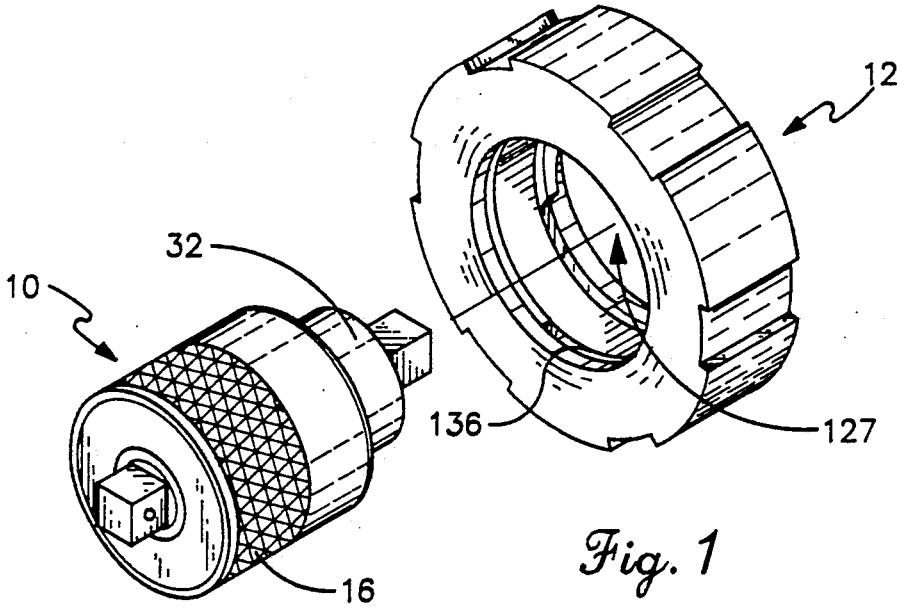
FIG. 1 is a perspective view of improved speed wrench and hand grip according to the preferred embodiment of the present invention in a position just prior to being nested together.

The present invention is directed to tool devices, and particularly to tools adapted to be manually rotated in order to rotationally drive a work pieces. Thus, the present invention is specifically useful in combination with a speed wrench device, as an improvement thereto. The improvement according to the preferred embodiment of the present invention, then, includes a drive head structure which is rigidly secured to the speed wrench or other tool so that the user may employ an auxillary lever-type wrench to apply increased torque to the tool. An improved complimentary hand grip is also provided in the preferred embodiment of the present invention, both for the comfort of the user and in order to allow the user to gain some additional mechanical advantage in rotating the tool. In FIG. 1, a preferred embodiment of the present invention is shown as a combination of an improved speed wrench 10 and an improved complimentary hand grip 12. Speed wrench 10 includes a bail 32 sized to matably engage a keyway 127 in hand grip 12, and hand grip 12 includes a detent retaining ring 138 operative to secure hand grip 12 onto speed wrench 10, all as described more thoroughly below.

Figure 3:
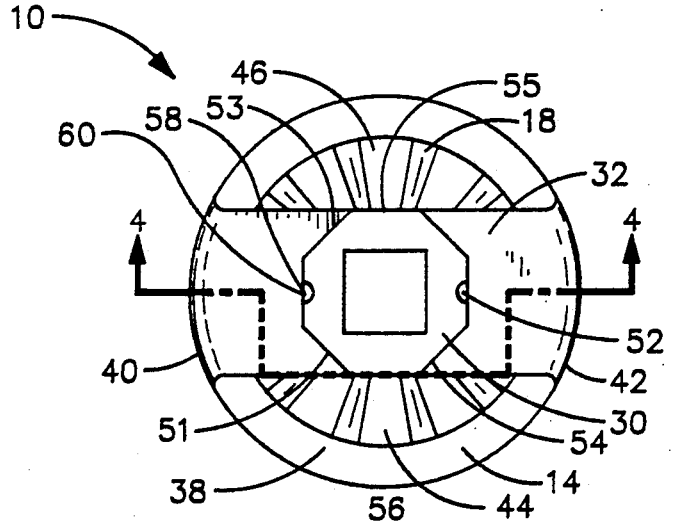
FIG. 3 is a top view of the speed wrench shown in FIG. 2.
Figure 2:
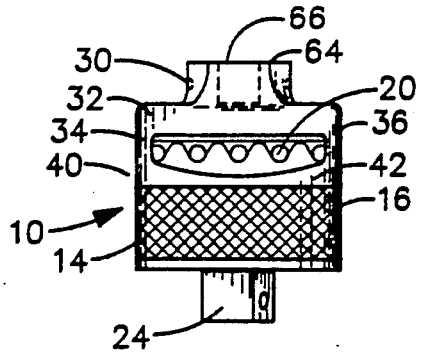
FIG. 2 is a side view of the speed wrench shown in FIG. 1.
Figure 4:
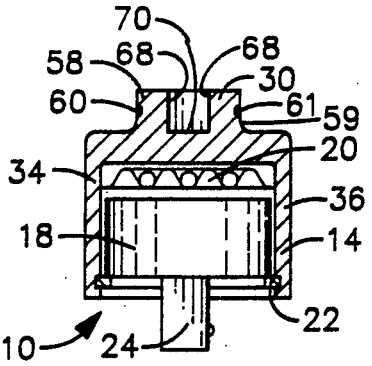
FIG. 4 is a partial cross-section view taken about lines 4—4 of FIG. 3.
Figure 5:
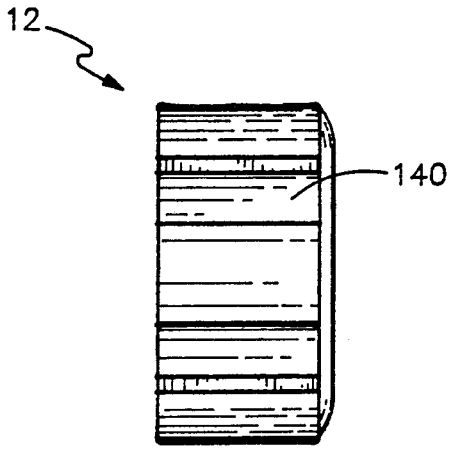
FIG. 5 is a side view of the hand grip shown in FIG. 1.
Figure 6:
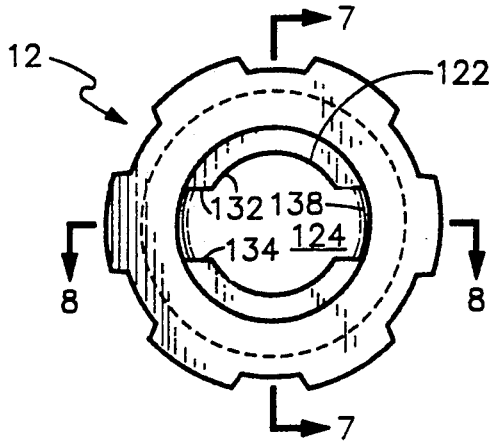
FIG. 6 is a top view of the hand grip shown in FIG. 5.
Figure 7:
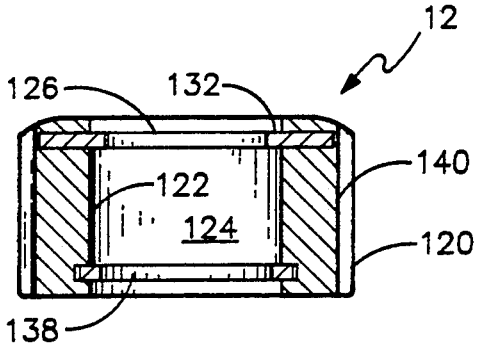
FIG. 7 is a cross-sectional view taken about lines 8—8 of FIG. 6.
Figure 8:
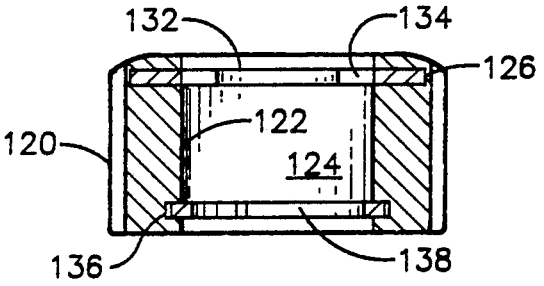
FIG. 8 is a cross-sectional view taken about lines 7—7 in FIG. 6.

The construction of the improved speed wrench 10 is best shown in FIGS. 2–4, and the construction of improved complimentary hand grip 12 is best shown in FIGS. 5–8.

As is shown in FIGS. 2–4, speed wrench 10 has an outer casing 14 which is preferably of generally cylindrical form with a surrounding sidewall which has an external surface provided with knurling 16. A drive mechanism 18 is housed in the interior of casing 14, with drive mechanism 18 preferably being a reversing ratchet mechanism of any of the numerous types known in the art. To this end, a reversing member 20 operates to switch the reversing ratchet mechanism 18 between opposite drive directions; the structures of the mechanism 18 and element 20 are not shown and do not form part of this invention. Drive mechanism 18 is held in position within the interior of casing 14 by means of a spring clip 22, shown in FIG. 4.

Drive mechanism 18 includes a shank or drive member 24 which projects axially from one side of casing 14 and is adapted to selectively mount a tool element, such as a socket, in order to engage a work piece so that the work piece may be correspondingly rotated upon rotation of casing 14 and drive mechanism 18. It should be appreciated, though, that within the scope of the present invention, drive member 24 could be constructed as a tool element which directly engages the work piece. To this end, it is entirely within the scope of the present invention that drive member 24 be configured as a nut driver, a screwdriver, or any other tool that is normally used to rotate a work piece. As is shown in FIGS. 2 and 4, drive member 24 is provided with a ball detent 26 so that a tool element, such as a socket, may be releasably retained on drive member 24.

The improvement according to the preferred embodiment of the present invention includes a drive head 30 which is rigidly secured to speed wrench 10 by means of a strap-like bail 32 of a length equal to the diameter of the cylindrical casing and having end portions 34 and 36 which are rigidly attached to an upper edge 38 of casing 14. The outer surfaces of end portions 34, 36 form an extension of the cylindrical surrounding sidewall of casing 14. To this end, end portions 34 and 36 are secured at opposite diameteric edge portions 40 and 42 of edge 38, respectively. Since bail 32 extends diametrically across a second side of casing 14 opposite drive member 24, a pair of openings 44 and 46 are formed 5 between bail 32 and edge 38 of casing 14. Openings 44 and 46 allow ready access to reversing member 20 so that reversing member 20 may be manipulated in order to change the drive direction of reversing ratchet mechanism 18.

As is best shown in FIG. 3, drive head 30 is preferably formed as a post having pairs of flat exterior sides. Drive head 30 is a generally hexagonal piece having flat exterior sides 51–56 which are generally oriented in planes parallel to the common axis of drive member 24 and drive head 30. A pair of flattened portions 58 and 59 are located opposite one another and are provided with dimples 60 and 61, respectively. Exterior sides 51 through 56 are organized as substantially planar pairs of sides, such as pair 51, 52, pair 53, 54 and pair 55, 56.

Drive head 30 is oriented axially of casing 14 so that it is along a common axis with drive member 24. Drive head 30 terminates in a raised surface 64 that is generally oriented in a plane transverse to the common axis of drive head 30 and drive member 24, a cavity 66 is formed in raised surface 64 and projects inwardly and axially of drive head 30. Preferably, cavity 66 is square-shaped in cross-section so that it has flat interior sidewalls 68 and a bottom wall 70. Sidewalls 68 are, accordingly, oriented along planes generally parallel to the common axis of drive head 30 and drive member 24. Cavity 66 could take on other geometrical configurations, in order to match conventional drive lugs of lever-type wrenches. For example, cavity 66 could have a hexagonal cross-section to receive a hexagonal lug.

Figure 11:
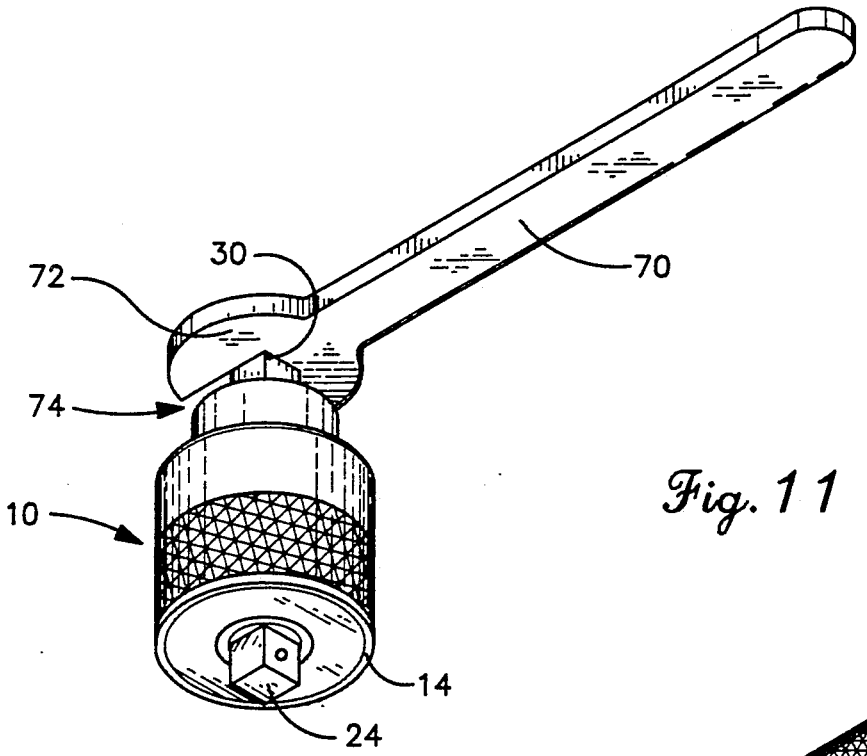
FIG. 11 is a perspective view of the speed wrench and engagement with the flat sides of the drive head.
Figure 12:
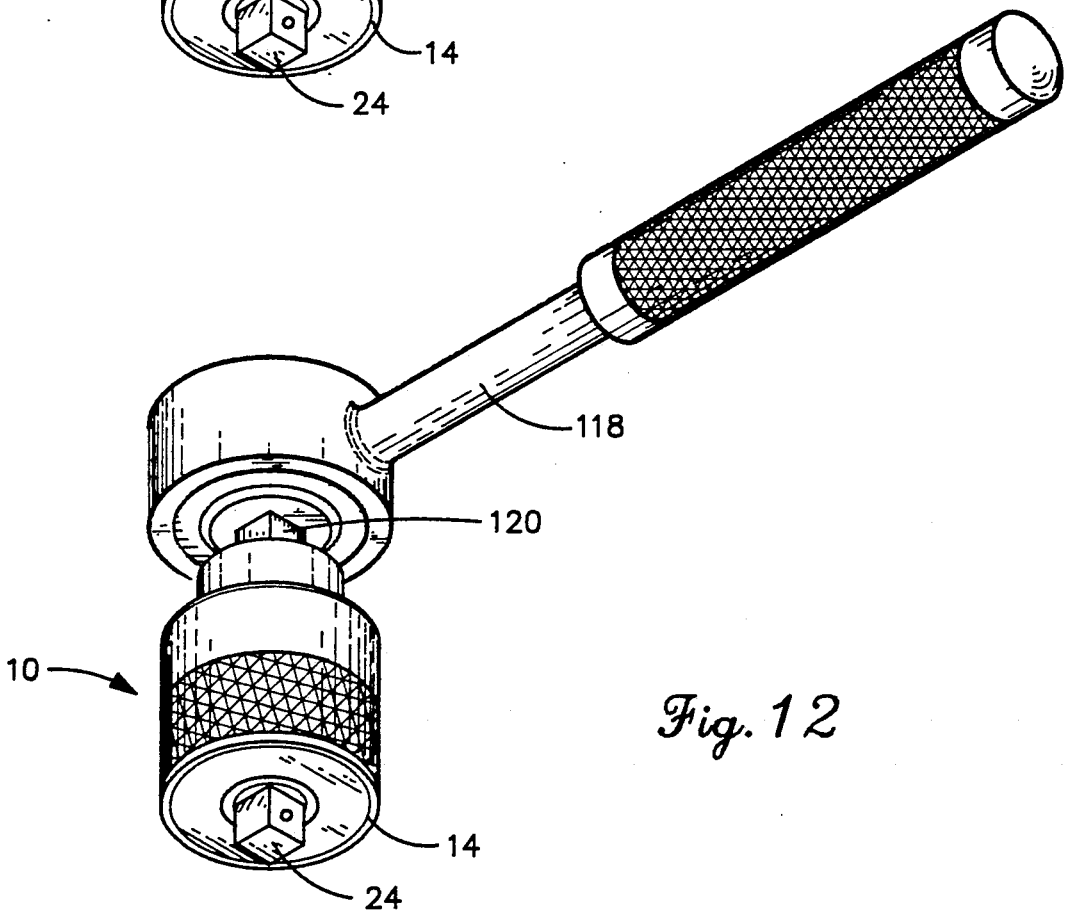
FIG. 12 is a perspective view of the speed wrench and a ratchet wrench in engagement with the interior walls of the cavity of the drive head.

Before turning to a description of complimentary hand grip 12 and its relationship with speed wrench 10, it should be appreciated that the improvement described above allows a user to gain additional mechanical advantage in rotating wrench 10 by means of numerous conventional wrenches or ratchet drives, such as shown in FIGS. 11 and 12. As is shown in FIG. 11, speed wrench 10 may be manipulated by means of a standard open end wrench 70 which has a wrench head 72 provided with a slot 74 sized to engage one of the pairs of flat sides 51–56. Since a drive head 30 is rigidly secured to casing 14, angular movement of wrench 70 about the axis of drive head 30 will rotate speed wrench 10 so that drive member 24 will rotate any tool piece secured thereto. Thus, the user may manually operate speed wrench 10 until the work piece is tightened to a desired degree. Then, the user may engage drive head 30 with wrench 70 without removing speed wrench 10 from the work piece so that additional torque may be applied to further tighten the work piece. Naturally, the converse of this procedure may be utilized to rotate the work piece in an opposite direction for loosening the work piece.

As noted above, an improved complimentary hand grip 12 is provided for use with speed wrench 10. The structure of hand grip 12 is shown in FIG. 1 and in greater detail in FIGS. 5–8. As is shown in these figures, hand grip 12 is constructed with an annular grip portion 120 which has an inner side wall 122 defining a cylindrical opening 124 which has a diameter only slightly larger than the outer diameter of casing 14 such that, when the hand grip 12 is placed over the speed wrench 10, inner wall 122 surrounds the casing 14 in a sliding fit. Grip portion 120 may be molded of high impact plastic.

Figure 9:
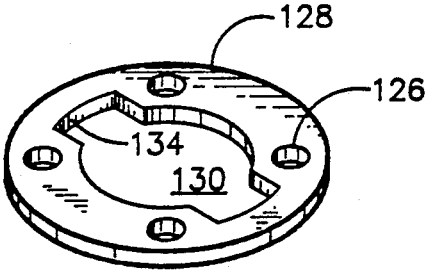
FIG. 9 is a perspective view of the drive ring of the hand grip of FIGS. 1, 5, 6, 7 and 8.

In the preferred embodiment of complimentary hand grip 12 shown in FIGS. 5–8, bail engagement means and axial positioning means are provided by drive ring 126 shown in FIG. 9. In the exemplary preferred embodiment, where the grip portion 120 is formed of molded plastic, the grip portion 120 is molded about drive ring 126 to bond drive ring 126 within the grip portion 120. Drive ring 126 may be formed with a plurality of ports 128 so that, during the molding process, plastic material may flow through the ports 1–8 to facilitate bonding of the drive ring 126 to the grip portion 120. Drive ring 126 is formed with a circular center opening 130 and bail engagement notches 134 that together define a keyway 127. Circular opening 130 has a smaller diameter than cylindrical opening 124 so that, when drive ring 126 is bonded in annular grip portion 120, an inside edge of drive ring 126 protrudes from the inside wall 122 of grip portion 120 to form a casing stop 132. Casing stop 132 rests on the bail side of casing 14 when complimentary hand grip 12 is placed over speed wrench 10 in the nested position with bail engagement notches 134 matably engaging bail 32 near bail end portions 34 and 36 adjacent the points of attachment along the edge of casing 14.

In the preferred embodiment of hand grip 12, annular groove 136 retains a split retaining ring 138 spaced at such an axial distance from casing stop 132 that, when hand grip 12 is pushed down over speed wrench 10 to its nested position, with casing stop 132 resting on the top edge of casing 14, thus forming a detent retaining ring 136 will be just beneath the drive side of casing 14 to resiliently retain hand grip 12 in the nested position.

When the complimentary hand grip 12 is in the nested position, such that bail engagement notches 134 of drive ring 126 engage the end portions 34 and 36 of bail 32, rotational torque applied to the complimentary hand grip 12 will be transmitted through the drive ring 126 to the bail 32 and, in turn, to casing 14. Because the bail engagement notches 134 of drive ring 126 engage bail 32 near its points of attachment at the outside edge of casing 14, at the greatest possible distance from the rotational axis of speed wrench 10, the forces exerted at the points of engagement are minimized for a given torque. This minimizes stress and wear on the wrench 10 and engagement notches 134 of the hand grip 12. The annular grip portion 120 of the improved complimentary hand grip 12 may be provided with longitudinal grooves 140 in its outer surface to facilitate twisting of the hand grip 12.

Drive ring 134 may be formed of any suitably hard and resilient material, for example, formed in a single operation by stamping from sheet metal. Where a metallic drive ring 126 is utilized together with a molded plastic annular grip portion 120, the strength and wear advantage of metallic engagement surfaces is combined with the thermal and electrical insulative qualities of molded plastic. In the exemplary preferred embodiment stress developed where the bail engagement notches 134 transfer force to the bail 32 is transferred to the molded plastic annular grip portion 120 over the entire circumference of the drive ring 126 minimizing stress which must be accommodated by the bond to the molded plastic.

Figure 10:
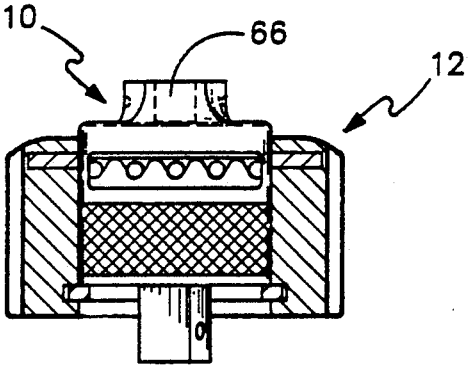
FIG. 10 is a partial sectional view of the hand grip engaging the speed wrench in the nested condition.

FIG. 10 is a partial section view showing speed wrench 10 nested within hand grip 12. It may be appreciated from the foregoing description and FIG. 10 that, with the speed wrench 10 nested in drive head 12, drive member 24 may be attached to a work tool or work piece. The user may then manipulate hand grip 12 to rotate socket 16 in order to rotate a work piece. At such time that the user desires to gain mechanical advantage in turning the wrench, the user may directly engage cavity 66 of drive head 30 by means of a wrench. It should be appreciated that mated insertion of a wrench with a conventional drive member or lug that is sized to be inserted into cavity 66 may be accomplished without removing hand grip 12 from speed wrench 10. Lug 120 is typically square shaped in cross section, but may take other geometrical shapes, such as hexagonal cross section.

Accordingly, the present invention has been described with some degree of particularly directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. In a tool adapted to rotatable drive a work piece wherein said tool includes a casing with a cylindrical outer surface which mounts a drive mechanism having a drive member that projects axially from one side of the casing and that is adapted to selectively engage the work piece whereby rotation of said casing rotates said work piece, the improvement comprising a drive head rigidly attached to said tool and projecting axially from said casing on a second side thereof opposite said drive member, said drive head having a raised surface generally in a plane transverse to the common axis of said drive member and said drive head and having a plurality of flat exterior sides oriented along exterior planes which are parallel to said common axis, at least some of said exterior sides being parallel to one another, said drive head having an axial cavity formed in said raised surface, said cavity having a plurality of flat interior sidewalls oriented along interior planes which are parallel to said common axis, and a strap-like bail member extending across said casing on the second side thereof with said bail member having radial end portions attached to diametrically opposite outermost edge portions of said casing and extending upwardly therefrom coextensive with the cylindrical outer surface of said casing to maintain said bail in fixed set apart relation to a surface of said second side.

2. The improvement according to claim 1 wherein said cavity is square in cross-section about a plane transverse to said common axis and is adapted to matably engage a lug of an auxillary wrench whereby said auxillary wrench may be manipulated to apply leveraged mechanical torque to said drive member.

3. The improvement according to claim 1 wherein said drive head is directly attached to said casing.

4. The improvement according to claim 1 wherein said casing, said bail member and said drive head are formed of an integral one-piece construction.

5. The improvement according to claim 1 further comprising a hand grip sized to receive said tool in nested relation, said hand grip including an annular grip portion having an inner wall defining a cylindrical opening, a casing stop and a means for engaging said bail member, arrangement of said opening, said casing stop and said bail member engagement means being such that said hand grip will matably receive said casing and bail in a nested state whereby said hand grip may be rotated about said common axis to correspondingly rotate said work piece.

6. The improvement according to claim 5 including detent means on said hand grip for releasably retaining said hand grip and tool in the nested state.

7. The improvement according to claim 5 wherein said tool and said hand grip include registration means for permitting the nested state only at selected relative rotational positions.

8. The improvement according to claim 5 in which said hand grip further includes a circular drive ring, said drive ring having an inner edge defining a central circular opening with a diameter smaller than a diameter of said cylindrical opening, and in which said annular grip portion is molded unitarily about said drive ring in such a manner that said inner edge comprises said casing stop.

9. The improvement according to claim 8 in which said inner edge of said drive ring further comprises said bail engagement means.

10. The improvement according to claim 9 in which said bail engagement means includes bail engagement notches formed in said inner edge whereby said inner edge configures a keyway sized to engage the bail.

11. A speed wrench adapted to be both manually rotated abuot a central axis and selectively engaged by a wrenching tool having a working element in order to rotatably drive a tool that correspondingly drives a work piece, comprising:

a casing having a cylindrical exterior surface:

a reversible ratchet mechanism switchable between first and second drive states corresponding to opposite rotational drive directions, said drive mechanism being mounted in said casing and including a drive shaft projecting axially of said casing on a first side thereof adapted to couple a tool element whereby manual rotation of said casing will rotatably drive said drive shaft in a selected one of said drive directions;

a mechanical switch member connected to said ratchet mechanism to selectively switch said ratchet mechanism between said first and second rotational drive states; and a drive head rigidly and axially attached to said casing on a second side thereof opposite said drive shaft and along a common axis therewith, said drive head comprising a bail member attached at opposite diametric locations on said casing and formed as a smooth uninterrupted extension of said cylindrical surface and having an opening sized to permit access to said mechanical switch member, said drive member configured to be engaged by the working element of said wrenching tool whereby said casing may be rotated with increased mechanical advantage by said wrenching tool.

12. A speed wrench according to claim 11 wherein said bail member having end portions rigidly attached to said casing.

13. A speed wrench according to claim 12 wherein said bail member has a strap-like configuration extending diametrically across said casing.

14. A speed wrench according to claim 11 wherein said drive head has a plurality of flat exterior sides oriented along exterior planes which are parallel to said common axis, at least some of said exterior sides being parallel to one another.

15. A speed wrench according to claim 14 wherein there are six exterior sides adapted to be engaged by said wrenching tool along the exterior of said drive head, said six exterior sides being organized as three parallel pairs of exterior sides in a generally hexagonal configuration.

16. A speed wrench according to claim 11 wherein said drive head has a cavity axially formed therein, and opening oppositely of said drive shaft, said cavity having a plurality of flat interior sidewall oriented along interior planes which are parallel to said common axis, said wrenching tool having a lug adapted to be matably received within said cavity.

17. The improvement according to claim 12 further comprising a hand grip sized to receive said tool in nested relation, said hand grip including an annular grip portion having an inter wall defining a cylindrical opening, a casing stop and a means for engaging said bail member, arrangement of said opening, said casing stop and said bail member engagement means arranged such that said hand grip will matably receive said casing and bail in a nested state whereby said hand grip may be rotated about said common axis to correspondingly rotate said work piece.

18. The improvement according to claim 17, further including detent means on saisd hand grip for releasably retaining said hand grip and tool in the nested state.

19. The improvement according to claim 18 wherein said tool and said hand grip include registration means for permitting the nested state only at selected relative rotational positions.

20. The improvement according to claim 18 further including a circular drive ring, said drive ring having an inner edge defining a central circular opening with a diameter smaller than a diameter of said cylindrical opening, said annular grip portion molded unitarily about said drive ring in such a manner that said inner edge comprises said casing stop.

21. The improvement according to claim 20 in which said inner edge further comprises said bail engagement means.

22. The improvement according to claim 20 in which said bail engagement means includes bail engagement notches formed in said inner edge.

* * * * *